US009410743B2

(12) United States Patent
Takahashi

(10) Patent No.: US 9,410,743 B2
(45) Date of Patent: Aug. 9, 2016

(54) METAL MELTING FURNACE VORTEX CHAMBER BODY AND METAL MELTING FURNACE USING THE SAME

(71) Applicant: Kenzo Takahashi, Matsudo (JP)

(72) Inventor: Kenzo Takahashi, Matsudo (JP)

( * ) Notice: Subject to any disclaimer, the term of this patent is extended or adjusted under 35 U.S.C. 154(b) by 49 days.

(21) Appl. No.: 14/126,171

(22) PCT Filed: Sep. 27, 2012

(86) PCT No.: PCT/JP2012/074913

§ 371 (c)(1),
(2) Date: Dec. 13, 2013

(87) PCT Pub. No.: WO2013/047668

PCT Pub. Date: Apr. 4, 2013

(65) Prior Publication Data

US 2014/0210145 A1 Jul. 31, 2014

(30) Foreign Application Priority Data

Sep. 30, 2011 (JP) ..... 2011-217851

(51) Int. Cl.
*F27B 3/04* (2006.01)
*B22D 1/00* (2006.01)
(Continued)

(52) U.S. Cl.
CPC ... *F27B 3/04* (2013.01); *B22D 1/00* (2013.01); *F27B 3/045* (2013.01); *F27B 3/19* (2013.01); *F27B 19/02* (2013.01); *F27D 3/14* (2013.01); *F27D 27/00* (2013.01); *F27D 99/007* (2013.01); *F27D 2003/0054* (2013.01)

(58) Field of Classification Search
CPC ..... F27D 27/00; F27B 3/04
USPC ..... 266/233, 234
See application file for complete search history.

(56) References Cited

U.S. PATENT DOCUMENTS 4,685,657 A * 8/1987 Okubo ..... C22B 9/02 266/234
4,839,904 A 6/1989 Harberts et al.
(Continued)

FOREIGN PATENT DOCUMENTS

CA 2 535 528 A1 8/2006
CN 201688718 U 12/2010
(Continued)

OTHER PUBLICATIONS

U.S. Appl. No. 14/115,788, filed Nov. 5, 2013, Takahashi.
(Continued)

*Primary Examiner* — Scott Kastler
(74) *Attorney, Agent, or Firm* — Oblon, McClelland, Maier & Neustadt, L.L.P.

(57) ABSTRACT

A metal melting furnace vortex chamber body having a vortex chamber capable of communicating with a storage space of a furnace body having the storage space storing molten metal. The metal melting furnace vortex chamber body has a drop weir part which switches a communication state and an interruption state between the storage space and the vortex chamber. The drop weir part includes a blind drop weir and an opening type drop weir which are formed as separate members. At least the blind drop weir is movable up and down with respect to the vortex chamber body and is selectively positioned at an upward movement position and a downward movement position so as to switch the communication state and the interruption state.

13 Claims, 5 Drawing Sheets

(51) Int. Cl.

| | |
|---|---|
| ***F27D 27/00*** | (2010.01) |
| ***F27B 3/19*** | (2006.01) |
| ***F27B 19/02*** | (2006.01) |
| ***F27D 3/14*** | (2006.01) |
| ***F27D 99/00*** | (2010.01) |
| *F27D 3/00* | (2006.01) |

(56) References Cited

U.S. PATENT DOCUMENTS

| | | | | |
|---|---|---|---|---|
| 8,703,043 | B2 | 4/2014 | Takahashi | |
| 2014/0210145 | A1* | 7/2014 | Takahashi | B22D 1/00 266/233 |
| 2014/0284854 | A1* | 9/2014 | Takahashi | F27D 27/00 266/234 |

FOREIGN PATENT DOCUMENTS

| | | | |
|---|---|---|---|
| EP | 0 176 296 | A1 | 4/1986 |
| GB | 2 207 225 | A | 1/1989 |
| JP | 5 156378 | | 6/1993 |
| JP | 9 155512 | | 6/1997 |
| JP | 2002 81632 | | 3/2002 |
| JP | 2010-5647 | A | 1/2010 |
| JP | 2010-281474 | | 12/2010 |
| JP | 2011 17521 | | 1/2011 |
| KR | 10-2001-0026585 | | 4/2001 |

OTHER PUBLICATIONS

U.S. Appl. No. 14/111,130, filed Oct. 10, 2013, Takahashi.

Extended European Search Report issued Mar. 26, 2015 in Patent Application No. 12836337.1.

International Search Report Issued Oct. 23, 2012 in PCT/JP12/074913 Filed Sep. 27, 2012.

Office Action issued Oct. 19, 2015 in Korean Patent Application No. 10-2013-7033971 (with English translation).

* cited by examiner

METAL MELTING FURNACE VORTEX CHAMBER BODY AND METAL MELTING FURNACE USING THE SAME

BACKGROUND

1. Field of the Invention

The present invention relates to a metal melting furnace vortex chamber body and a metal melting furnace using the same. For example, the present invention relates to a vortex chamber body which is used in a metal melting furnace for conductors (conductive materials) such as Al, Cu, and Zn, alloy of at least two of Al, Cu, and Zn, or Mg-alloy, and a metal melting furnace using the same.

2. Description of Related Art

Hitherto, there have been known methods of generating a vortex inside a vortex chamber body by disposing an electromagnetic coil on the outer circumference of the vortex chamber body or disposing a permanent magnet type shifting magnetic field generator below the vortex chamber body. The vortex chamber body and a furnace body may be integrated with each other or may be connected to each other by flange joints.

Even in any of these methods, the vortex chamber body and the furnace body are connected to each other by a molten metal inlet and a molten metal outlet bored in a furnace wall of the furnace body. Since molten metal rapidly rotates inside the vortex chamber body and a non-melted material rapidly rotates therein, an inner wall of the vortex chamber body is intensively abraded. For this reason, when the management is not sufficiently performed, a molten metal leakage accident occurs in some cases.

This is because the vortex is generated by a molten metal outer circumferential driving method, hence the vortex chamber wall thickness may not be increased. The molten metal leakage accident directly leads to an accident in which the molten metal of the furnace body leaks. In this case, a large amount of the molten metal comes out of the furnace, so that a very dangerous severe accident occurs.

Therefore, it is considered that the vortex chamber needs to be naturally replaced when the durable years expire. Accordingly, there has been expected a rapid melting furnace vortex chamber capable of safely stopping a work even when the molten metal leakage accident occurs during the operation of the rapid melting furnace.

SUMMARY OF THE INVENTION

Technical Problem

The present invention is made to solve the above problems. It is an object of the present invention to provide a metal melting furnace vortex chamber body which is able to prevent accident, be easily maintained and be simple structure, and a metal melting furnace using the same.

Solution to Problem

The present invention provides a metal melting furnace vortex chamber body with a vortex chamber capable of communicating with a storage space of a furnace body having the storage space storing molten metal, the metal melting furnace vortex chamber body comprising:

a drop weir part which switches a communication state and an interruption state between the storage space and the vortex chamber, wherein the drop weir part includes a blind drop weir and an opening type drop weir which are formed as separate members, wherein at least the blind drop weir is movable up and down with respect to the vortex chamber body and is selectively positioned at an upward movement position and a downward movement position so as to switch the communication state and the interruption state, and wherein the opening type drop weir includes notches which communicate the vortex chamber and the storage space with each other in the communication state.

The present invention provides a metal melting furnace comprising:

a furnace body which includes a storage space storing molten metal;

a vortex chamber body which includes a vortex chamber capable of communicating with the storage space of the furnace body; and a drop weir part which changes a communication state and an interruption state between the storage space and the vortex chamber, wherein the drop weir part includes a blind drop weir and an opening type drop weir which are formed as separate members, wherein at least the blind drop weir is movable up and down with respect to the vortex chamber body and is selectively positioned at an upward movement position and a downward movement position so as to switch the communication state and the interruption state, and wherein the opening type drop weir includes notches which communicate the vortex chamber and the storage space with each other in the communication state.

DETAILED DESCRIPTION OF THE INVENTION

Referring to FIGS. 1 to 7, a non-ferrous metal melting furnace of an embodiment of the present invention will be described.

The non-ferrous metal melting furnace of the embodiment of the present invention is where arbitrary metal or non-ferrous metal of a conductor (conductive material), for example, Al, Cu, and Zn, alloy of at least two of Al, Cu, and Zn, or Mg-alloy or the like is charged and heated with a burner or the like so as to be melted.

Figure 1:
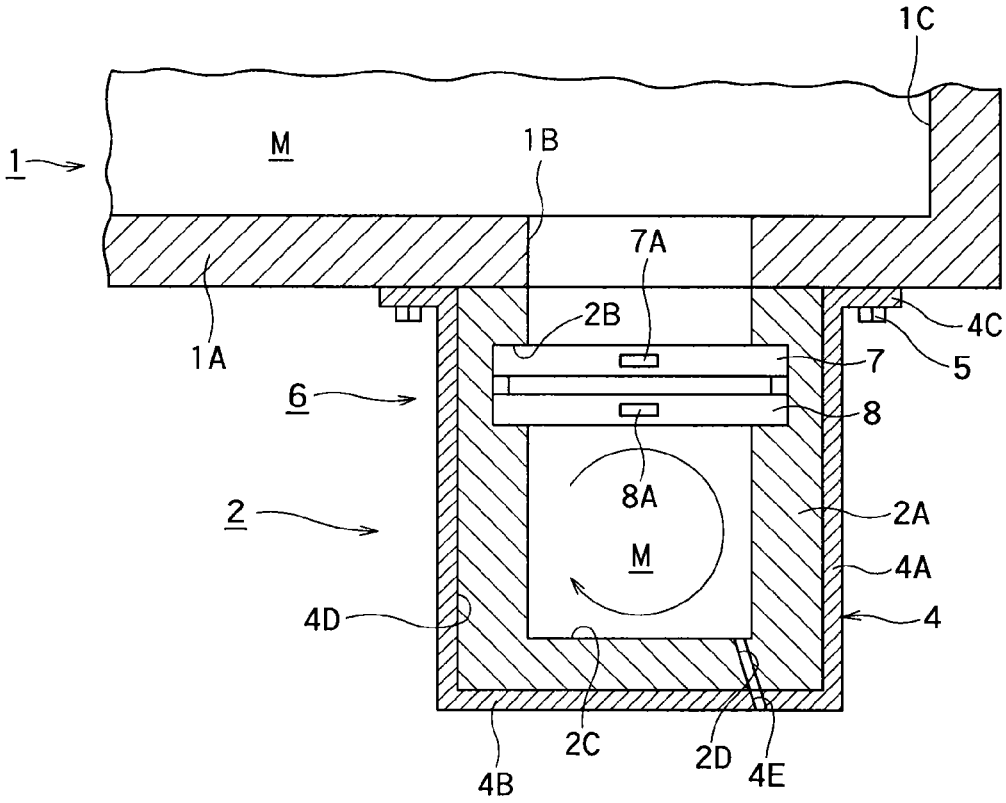
FIG. 1 is a partially cutaway plan view of a non-ferrous metal melting furnace of an embodiment of the present invention.

In this embodiment, as understood particularly from FIG. 1, a furnace body 1 and a vortex chamber body 2 are formed as separate members, and these members are mechanically coupled to each other by an attachment tool 5 so as to communicate with each other through an opening 1B bored in a side wall 1A of the furnace body 1.

The furnace body 1 has, for example, a capacity of several tons to several tens of tons and heats and melts an ingot or the like of non-ferrous metal or the like with a burner so as to make a molten metal M of the non-ferrous metal or the like. The furnace body 1 includes a storage space 1C which stores the molten metal M.

The vortex chamber body 2 has, for example, a capacity capable of storing several hundreds of kilograms of the molten metal M, and is generally used to melt non-ferrous metal as a raw material which is light like aluminum chips or the like to float on the surface of the molten metal M and is not easily melted. In the vortex chamber body 2, the molten metal M is rapidly rotated as a vortex while being heated with a burner or the like inside the furnace body so that the temperature of the molten metal increases, and chips or the like of the non-ferrous metal as a raw material are attracted into the vortex so as to be melted. The vortex chamber body 2 includes a vortex chamber 2C which stores the molten metal M.

The vortex chamber body 2 is formed as a channel shape of which one end is formed as a released end and the other end is formed as a blocked end, and the released end communicates with the storage space 1C.

The furnace body 1 and the vortex chamber body 2 communicate with each other, and the molten metal M of the non-ferrous metal circulates therebetween so that the liquid surface levels thereof match each other.

The attachment tool 5 may be of any type as long as the vortex chamber body 2 may be stably attached to the furnace body 1. In the embodiment, as understood particularly from FIGS. 7(*a*), 7(*b*), and 7(*c*), the attachment tool is formed as a channel shape of which one end is formed as a released end and the other end is formed as a blocked end as the vortex chamber body 2. More specifically, an attachment tool 4 includes a so-called channel-shaped attachment tool body 4A, a blocking plate 4B which blocks the channel, and a flange 4C which folds back the attachment tool body 4A outward at the released side, and a vortex chamber body support space 4D is formed by these members. Further, the attachment tool body 4A is provided with an opening 4E as understood particularly from FIG. 1.

Further, the released end side becomes the flange 4C which is used for the attachment to the furnace body 1. That is, the attachment tool 4 includes the vortex chamber body support space 4D which inevitably has a so-called channel shape. When the vortex chamber body 2 is stored in the vortex chamber body support space 4D of the attachment tool 4 and the flange 4A is fastened to the furnace body 1 with bolts 5, 5 . . . in this state, the vortex chamber body 2 is fixed to the furnace body 1. In this state, as described above, the vortex chamber 2C of the vortex chamber body 2 communicates with the storage space 1C of the furnace body 1 through the opening 1B as understood particularly from FIG. 1.

In addition, the vortex chamber body 2 includes a drain tap 2D which is used to drain the molten metal M in a case of, for example, emergency as understood particularly from FIG. 1. The opening 4E which communicates with the drain tap 2D is bored in the attachment tool 4.

Further, the vortex chamber body 2 is provided with a drop weir part 6. The drop weir part 6 includes a blind drop weir 7 and an opening type drop weir 8 as two weir plates, and these drop weirs are inserted into a vertical groove 2B formed inside a side wall 2A of the vortex chamber body 2 so as to be individually movable up and down. That is, the blind drop weir 7 is disposed at the side of the furnace body 1, and the opening type drop weir 8 is disposed at the opposite side to the furnace body 1.

These weirs 7 and 8 are assembled so that they may not only move up and down but also be completely taken out of the vortex chamber body 2. In this way, the weirs 7 and 8 may be separated from the vortex chamber body 2, so that the maintenance of the furnace body 1 and the vortex chamber body 2 may be performed in an extremely easy way. That is, it is hard to avoid a state where so-called sludges such as oxides are inevitably accumulated with the operation in the furnace body 1 and the vortex chamber body 2. However, since both the weirs 7 and 8 may be separated, there is an advantage that the weirs may be easily cleaned.

Figure 5:
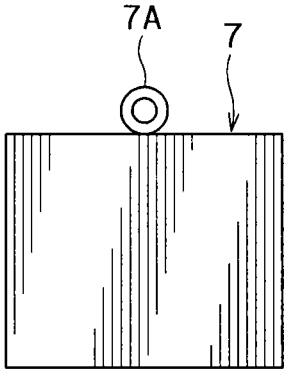
FIG. 5 is a front view illustrating a blind drop weir of the drop weir part of the non-ferrous metal melting furnace of FIG. 1.
Figure 6:
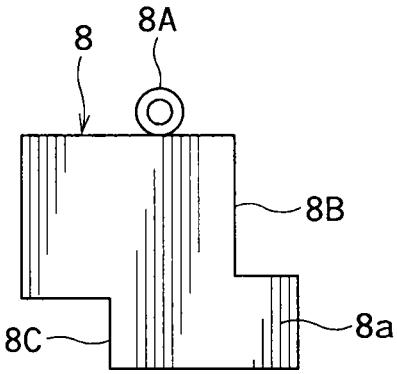
FIG. 6 is a front view illustrating an opening type drop weir of the drop weir part of the non-ferrous metal melting furnace of FIG. 1.
Figure 7:
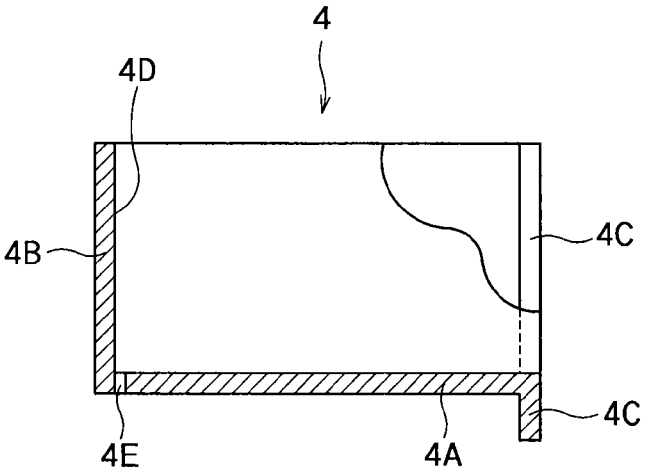
FIG. 7(*a*) is a partially cutaway side view of an attachment tool, 7(*b*) is a partially cutaway front view thereof, and 7(*c*) is a partially cutaway rear view thereof.
Figure 7:
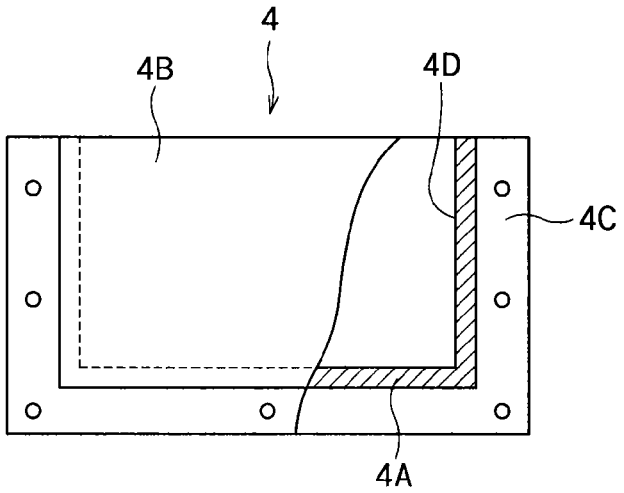
Figure 7:
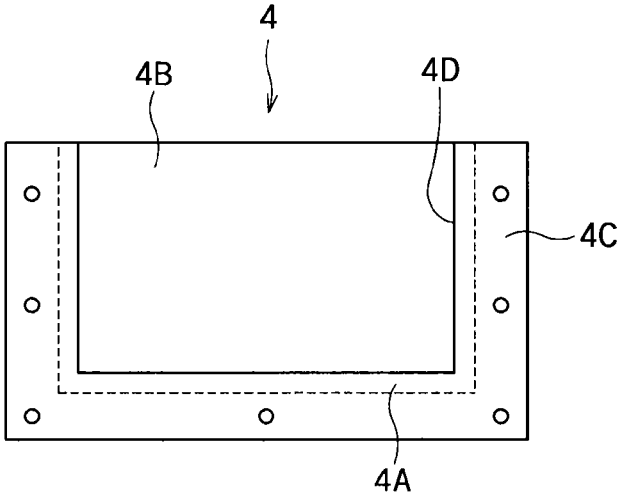

The blind drop weir 7 and the opening type drop weir 8 are respectively illustrated in FIGS. 5 and 6.

As shown in FIG. 5, the blind drop weir 7 is formed as a single plate shape, and a handle 7A is attached to the top portion thereof. As shown in FIG. 6, the opening type drop weir 8 includes an inlet opening 8B and an outlet opening 8C as notches formed at the left and right sides of the lower portion of one plate. That is, the outlet opening 8C and the inlet opening 8B are formed with a predetermined distance therebetween at the lower end side of a plate-like weir body 8*a* of the opening type drop weir 8. A handle 8A is provided.

Figure 3:
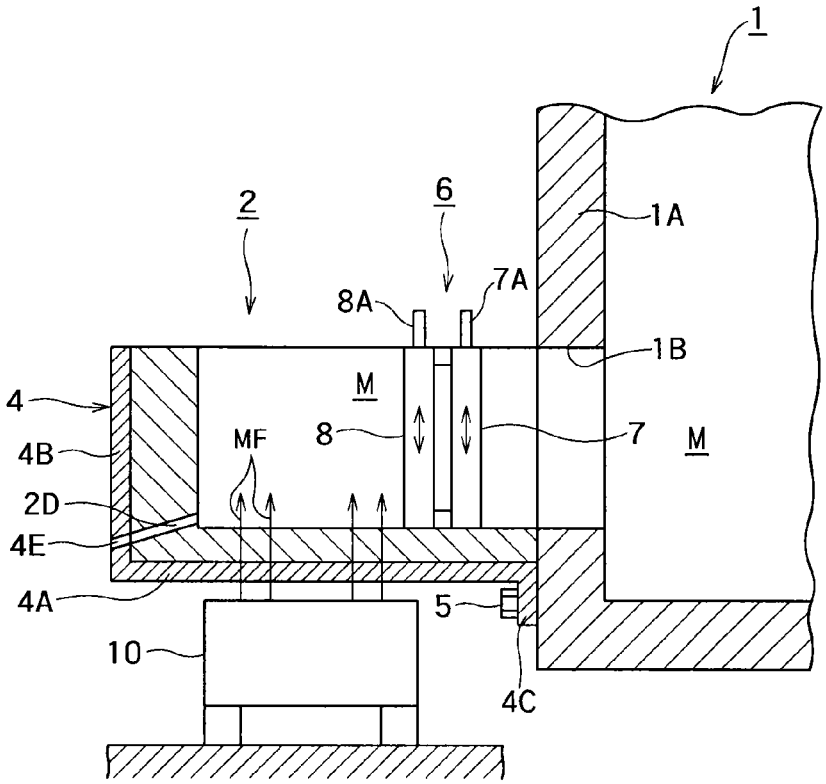
FIG. 3 is a partially cutaway right side view of the non-ferrous metal melting furnace of FIG. 1.
Figure 4:
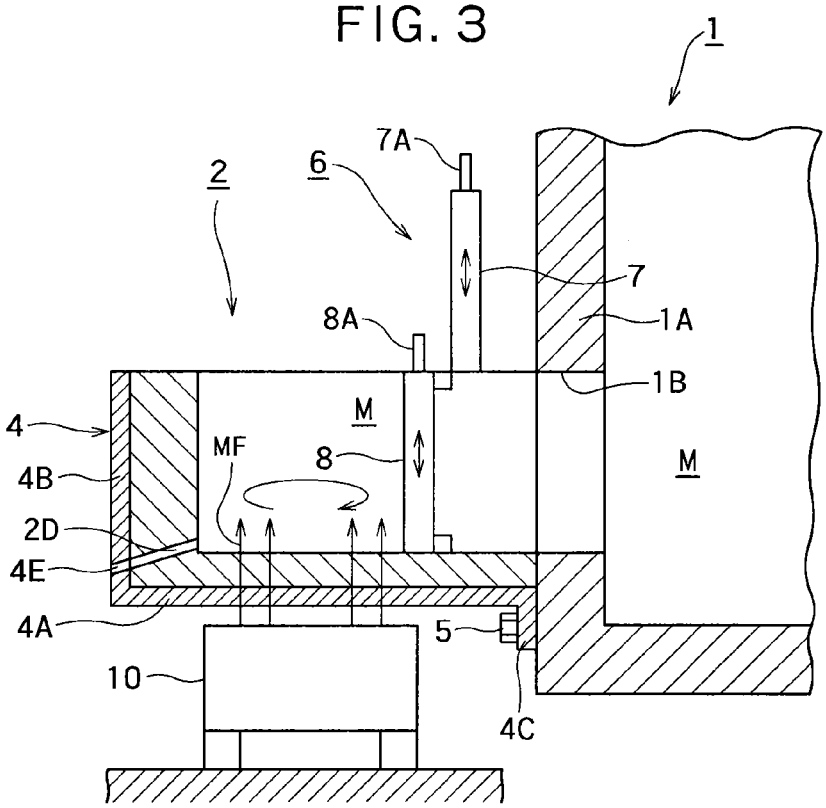
FIG. 4 is a partially cutaway side view for explaining an operation of a drop weir part of the non-ferrous metal melting furnace of FIG. 1.

As understood particularly from FIG. 3, the blind drop weir 7 and the opening type drop weir 8 are adapted to independently slide up and down and to stably take a downward movement position and an upward movement position. For example, the vortex chamber body 2 and the furnace body 1 are interrupted from each other in the state of FIG. 3, and the vortex chamber body 2 and the furnace body 1 communicate with each other through the inlet opening 8B and the outlet opening 8C in the state of FIG. 4.

As a mechanism of driving the two drop weirs, that is, the blind drop weir 7 and the opening type drop weir 8, in the up and down direction, various types such as a chain type, a screw type, a manual type and an electric type may be supposed. However, since the weirs 7 and 8 are extremely light in weight, a driving mechanism of any type is very simple. Here, a specific description thereof will be omitted. Further, the blind drop weir 7 and the opening type drop weir 8 may be formed of any material such as a fire-resisting material which has corrosion resistance with respect to the non-ferrous metal or the like and has a high thermal conductivity. A cheap fire-resisting material which is sold in the market is enough.

Figure 2:
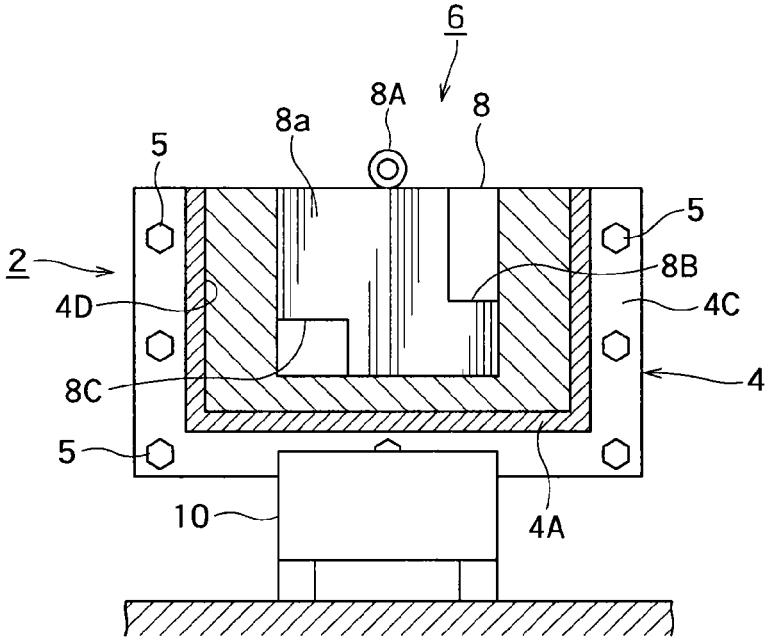
FIG. 2 is a partially cutaway front view of the non-ferrous metal melting furnace of FIG. 1.
Figure 8:
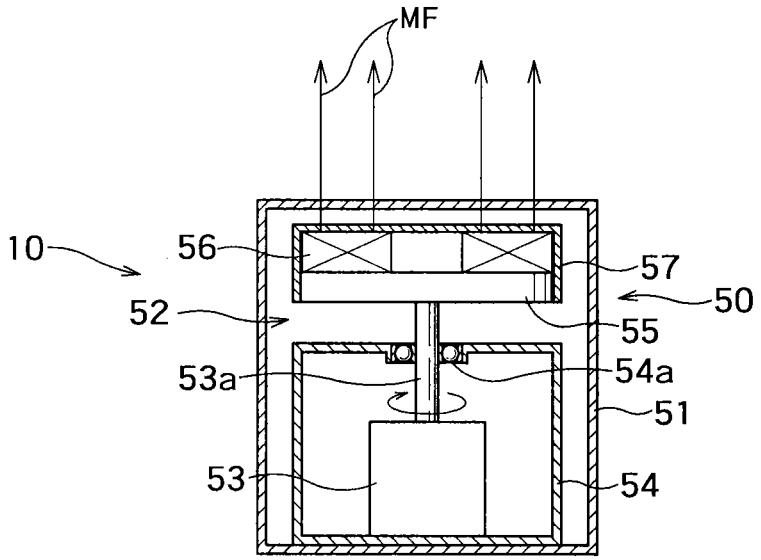
FIG. 8(*a*) is a longitudinal sectional view illustrating a shifting magnetic field generator and FIG. 8(*b*) is a diagram illustrating the arrangement of magnets.
Figure 8:
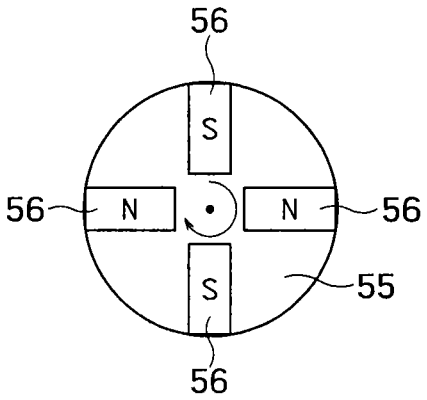

As understood particularly from FIG. 2, a permanent magnet type shifting magnetic field generator 10 is provided at the lower position outside the vortex chamber body 2. The shifting magnetic field generator 10 may be of an electromagnetic type. For example, the shifting magnetic field generator 10 shown in FIGS. 8(*a*) and 8(*b*) may be used. In FIGS. 8(*a*) and 8(*b*), a configuration may be employed in which a rotation magnet body 52 is provided inside a non-magnetic casing 51. In the rotation magnet body 52, a motor 53 is provided inside the casing 54, a shaft 53*a* of the motor 53 is supported by a bearing 54*a*, and a disk-like magnet base 55 is rotatable by the motor 53. A plurality of permanent magnets 56, 56 . . . are fixed onto the magnet base 55 at the interval of 90°. The upper and lower surfaces of the permanent magnets 56, 56 . . . are formed as magnetic poles. Furthermore, as understood from FIG. 8B, the adjacent permanent magnets 56, 56 . . . are magnetized so as to have different polarities. The permanent magnets 56, 56 . . . are covered by a non-magnetic cover 57.

With the above-described configuration, as shown in FIG. 3, a magnetic flux (magnetic lines of force) MF from the permanent magnets 56, 56 . . . penetrates the molten metal M inside the vortex chamber 6, or the magnetic flux MF penetrating the molten metal M enters the permanent magnets 56, 56 . . . . Since the permanent magnets 56, 56 . . . rotate in this state, the magnetic flux MF also moves inside the molten metal M, so that the molten metal M also rotates by the electromagnetic force.

By the rotational driving of the shifting magnetic field generator 10, the molten metal M inside the vortex chamber body 2 whirls by an eddy current and starts to rotate at a high speed, for example, 200 to 300 rpm. The molten metal M which rotates at a high speed is pressed in the outer circumferential direction inside the vortex chamber body 2 by the centrifugal force thereof. The force is strong at the lower side of the vortex chamber body 2. As a result, the molten metal is discharged from the outlet opening 8C of the opening type drop weir 8, and enters the furnace body 1. Further, the molten metal M inside the furnace body 1 returns from the inlet opening 8B to the vortex chamber body 2. When non-ferrous metal chips or the like are input into the vortex of the vortex chamber body 2, the chips or the like are attracted into the vortex, and hence may be rapidly melted.

In addition, the furnace body 1 includes, for example, a shifting magnetic field generator different from that of the vortex chamber body 2, and hence rotates the molten metal M at, for example, 20 to 30 rpm. Further, the molten metal M as a product may be derived from the furnace body 1 to the outside.

Next, a running operation of the above-described metal melting furnace will be described.

Before starting the operation of melting the molten metal M by the vortex chamber body 2, the molten metal M inside the furnace body 1 and the molten metal M inside the vortex chamber body 2 have the same liquid surface level. By the shifting magnetic field generator 10, the molten metal M inside the vortex chamber body 2 is rotated right as illustrated in FIG. 1.

In this state, chips or the like of non-ferrous metal as a raw material are input to the vortex chamber body 2. The chips or the like are further rotated while being attracted into the vortex of the molten metal M inside the rapidly rotating vortex chamber body 2 so as to be efficiently melted. The molten metal M which rotates inside the vortex chamber body 2 flows from the outlet opening 8C into the furnace body 1.

Accordingly, the liquid surface level of the molten metal M of the furnace body 1 becomes higher than the liquid surface level of the molten metal M inside the vortex chamber body 2. Thus, the molten metal M inside the furnace body 1 flows into the vortex chamber body 2 through the inlet opening 8B so that the liquid surface levels become equal to each other. That is, a difference in level, that is, a head is normally generated between the level of the molten metal M of the furnace body 1 and the level of the molten metal M of the vortex chamber body 2, so that the molten metal M circulates.

In this way, in the embodiment of the present invention, the molten metal M inside the vortex chamber body 2 is rotationally driven by the shifting magnetic field generator 10, so that chips or the like as an input raw material may be efficiently melted while being attracted into the vortex.

Incidentally, the embodiment of the present invention also has a feature in handling emergency case. That is, in general, the molten metal M rapidly rotates inside the vortex chamber body 2, and further a non-melted material as a raw material also rotates rapidly in this way. For this reason, it is hard to avoid a state where a non-melted raw material collides with the inner wall of the vortex chamber body 2. As a result, the inner wall of the vortex chamber body 2 is noticeably abraded, and hence the wall is thinned eventually. In addition, a stress such as expansion and contraction by heat is repeatedly applied to the inner wall of the vortex chamber body 2. Thus, the thinned inner wall of the vortex chamber body 2 is cracked by the stress, and hence the molten metal M inside the vortex chamber body 2 may leak to the outside. In this case, the molten metal M of the furnace body 1 is also leaks, and this case may cause a severe accident.

Incidentally, such an accident may be prevented according to the device of the embodiment of the present invention. That is, in a case where the vortex chamber body 2 is damaged, the blind drop weir 7 is promptly moved down so as to interrupt the communication between the vortex chamber body 2 and the furnace body 1, and hence an outlet 22 for the large amount of the molten metal M inside the furnace body 1 may be blocked.

Furthermore, after the communication is interrupted by the blind drop weir 7, the molten metal M which remains inside the vortex chamber body 2 may be promptly drained to the outside by the drain tap 2D and the opening 4E of the attachment tool 4. Accordingly, it is possible to prevent a case where the molten metal M remains inside the vortex chamber body 2 and is cooled and solidified inside the vortex chamber body 2. When the molten metal M is solidified inside the vortex chamber body 2, a severe damage is caused in that the vortex chamber body 2 and the furnace body 1 may not be used again, but this problem may be prevented by the embodiment.

Furthermore, the shape of the vortex chamber body 2 is formed as a rectangular shape (box shape) when viewed from the upside in the embodiment, but it is needless to mention that the shape may be a circular shape, a semi-circular shape, or an oval shape.

Further, it is needless to mention that the present invention may be applied to not only the above-described non-ferrous metal melting furnace, but also other metal melting furnaces.

What is claimed is:

1. A metal melting furnace vortex chamber body with a vortex chamber capable of communicating with a storage space of a furnace body having the storage space storing molten metal, the metal melting furnace vortex chamber body comprising:

a drop weir part which switches a communication state and an interruption state between the storage space and the vortex chamber, wherein the drop weir part includes a blind drop weir and an opening type drop weir which are formed as separate members, wherein at least the blind drop weir is movable up and down with respect to the vortex chamber body and is selectively positioned at an upward movement position and a downward movement position so as to switch the communication state and the interruption state, and wherein the opening type drop weir includes two notches which communicate the vortex chamber and the storage space with each other in the communication state, the vortex chamber includes only one communication opening in a wall of the storage space for communicating the vortex chamber with the storage space, the blind drop weir and the opening type drop weir are arranged in line in the communication opening, the two notches in the opening type drop weir are outlet and inlet openings which are formed in a plate-like weir body with a predetermined distance therebetween in the width direction, and the vortex chamber and the storage space are communicated with each other via the two notches in the communication opening.

2. The metal melting furnace vortex chamber body according to claim 1, wherein the blind drop weir and the opening type drop weir are all detachable from the vortex chamber body.

3. The metal melting furnace vortex chamber body according to claim 1, wherein the blind drop weir is provided in the vortex chamber body so as to be movable up and down and switches the communication state and the interruption state.

4. The metal melting furnace vortex chamber body according to claim 1, wherein the blind drop weir is disposed at the side of the furnace body and the opening type drop weir is disposed at the opposite side to the furnace body.

5. The metal melting furnace vortex chamber body according to claim 1, wherein the vortex chamber body is provided with a drain tap for draining the molten metal therethrough.

6. The metal melting furnace vortex chamber body according to claim 1, wherein a shifting magnetic field generator made of a permanent magnet is disposed at the outer lower side of the vortex chamber body so as to generate a magnetic field for rotationally driving the molten metal inside the vortex chamber body.

7. A metal melting furnace comprising:

a furnace body which includes a storage space storing molten metal;

a vortex chamber body which includes a vortex chamber capable of communicating with the storage space of the furnace body; and a drop weir part which changes a communication state and an interruption state between the storage space and the vortex chamber, wherein the drop weir part includes a blind drop weir and an opening type drop weir which are formed as separate members, wherein at least the blind drop weir is movable up and down with respect to the vortex chamber body and is selectively positioned at an upward movement position and a downward movement position so as to switch the communication state and the interruption state, and wherein the opening type drop weir includes two notches which communicate the vortex chamber and the storage space with each other in the communication state, the vortex chamber includes only one communication opening in a wall of the storage space for communicating the vortex chamber with the storage space, the blind drop weir and the opening type drop weir are arranged in line in the communication opening, the two notches in the opening type drop weir are outlet and inlet openings which are formed in a plate-like weir body with a predetermined distance therebetween in the width direction, and the vortex chamber and the storage space are communicated with each other via the two notches in the communication opening.

8. The metal melting furnace according to claim 7, wherein the blind drop weir and the opening type drop weir are all detachable from the vortex chamber body.

9. The metal melting furnace according to claim 7, wherein the vortex chamber body is formed as a channel shape of which one end is formed as a released end and the other end is formed as a blocked end, and the released end is connected to a communication port bored in a side wall of the furnace body so as to cause the storage space and the vortex chamber to communicate with each other.

10. The metal melting furnace according to claim 7, wherein the drop weir part is provided in the vortex chamber body.

11. The metal melting furnace according to claim 7, wherein the blind drop weir is disposed at the side of the furnace body and the opening type drop weir is disposed at the opposite side to the furnace body.

12. The metal melting furnace according to claim 7, wherein the vortex chamber body is provided with a drain tap for draining molten metal therethrough.

13. The metal melting furnace according to claim 7, wherein a shifting magnetic field generator made of a permanent magnet is disposed at the outer lower side of the vortex chamber body so as to generate a magnetic field for rotationally driving the molten metal inside the vortex chamber body.

* * * * *